US006391401B1

(12) United States Patent
Scheifele

(10) Patent No.: US 6,391,401 B1
(45) Date of Patent: May 21, 2002

(54) PACKAGING CONTAINER

(76) Inventor: Fredy Scheifele, Alpenblickstrasse 52, CH-8340, Hinwil (CH)

( * ) Notice: Subject to any disclaimer, the term of this patent is extended or adjusted under 35 U.S.C. 154(b) by 0 days.

(21) Appl. No.: 08/930,481

(22) PCT Filed: Jan. 24, 1997

(86) PCT No.: PCT/CH97/00022

§ 371 Date: Jan. 15, 1998

§ 102(e) Date: Jan. 15, 1998

(87) PCT Pub. No.: WO97/27120

PCT Pub. Date: Jul. 31, 1997

(30) Foreign Application Priority Data

Jan. 26, 1996 (CH) ..... 96/213

(51) Int. Cl.[7] ..... B29D 22/00; B32B 27/36

(52) U.S. Cl. ..... 428/34.1; 428/51; 428/35.9; 428/36.6; 428/446; 428/448; 428/474.4; 428/480

(58) Field of Search ..... 428/35.7, 51, 35.9, 428/36.6, 446, 448, 474.4, 480

(56) References Cited

U.S. PATENT DOCUMENTS

| | | | | |
|---|---|---|---|---|
| 4,799,488 A | | 1/1989 | Mintz | 128/637 |
| 5,085,904 A | * | 2/1992 | Deak et al. | 428/35.7 |

FOREIGN PATENT DOCUMENTS

| | | |
|---|---|---|
| EP | 0325440 | 7/1989 |
| EP | 0567383 | 10/1993 |
| FR | 2650569 | 2/1991 |
| GB | 2065067 | 6/1981 |
| GB | 2141723 | 1/1985 |

OTHER PUBLICATIONS

EPO Patent No. 0 496 704 A1.
Derwent Publication of JO 7032560.
Derwent Publication of JO8142293.

* cited by examiner

*Primary Examiner*—William P. Watkins, III
(74) *Attorney, Agent, or Firm*—Bachman & LaPointe, P.C.

(57) ABSTRACT

A transparent packaging container comprises a plastic tube having a welded longitudinal seam wherein the plastic is polyethylene terephthalate.(PET).

1 Claim, 1 Drawing Sheet

PACKAGING CONTAINER

BACKGROUND OF THE INVENTION

The invention concerns the use of polyethylene terephthalate for the production of transparent packaging containers which are formed by means of a welded longitudinal seam, in particular packaging tubes, and a tube formed from that plastic material.

Packaging containers, in particular transparent bottles of polyethylene terephthalate (identified by the abbreviation PET) are known, which have experienced a significant spread, by virtue of the good barrier action of the PET. Packaging containers are produced from the specified material by a procedure whereby a material blank is firstly injected in the form of a semimanufactured article. That blank is heated in the processing operation and is introduced into a mould which corresponds to the form of the container and in which the blank is inflated until it completely reproduces the shape of the container. Bottles produced in that way for example from the blank—also referred to as blow-moulded bottles—are as clear as glass (referred to for the sake of brevity as transparent) and do not have any flow seams or similar adverse surface effects caused by the moulding procedure. Besides transparent PET-bottles, transparent packaging containers of PET in tube form are also known. For the production thereof, in the same way as in the case of bottles, firstly a blank is injected, and the blank is heated upon further processing, but in contrast to the production of bottles, the heating operation is not effected in a blow mould but in a deep-drawing or stretching tool, in a procedure whereby the blank is converted in shape to constitute a tube which can be filled at one end, comprising a tube body with a tube head moulded thereon. Transparent tubes produced in that way however, in contrast to bottles, suffer from the disadvantage of adversely affected transparency which can no longer be considered to be as clear as glass, in accordance with the quality feature involved. The reason for this lies in changes in the crystalline structure as a result of the deep-drawing and stretching procedure. The most serious disadvantage however is the fact that tubes produced by deep drawing and stretching can only be decorated at high cost in terms of printing procedures. Inevitably packaging containers produced in that way have to be decorated or printed upon, while rotating, in a condition of being carried on a bar or mandrel, this being in contrast to printing on a foil strip in a flat condition, which is subsequently converted into the shape of a tube body. In comparison therewith, packaging containers, in particular tubes, which are produced by deep-drawing and stretching enjoy the advantage of so-called "handling neutrality". The term "handling neutrality" is used to denote an impression of feel in respect of the container, which is unimpaired on the part of the user. A container does not enjoy "handling neutrality" for example when regions of a container where it is felt or gripped have perceptible surface deformations or impairments, for example welded seams, portions corresponding to the shape of joins in moulds, and so forth. From the point of view of the packer using packaging containers and in particular packaging tubes, "handling neutrality", besides the mechanical-technological properties of a packaging container, is a quite essential quality feature which is customer-oriented from the point of view of the packager.

Tubes of plastic materials are known, the tube bodies of which, taking strips of plastic foil as the basic starting point, are formed by longitudinal shaping of the strip to form a tube and welding of mutually superposed edge portions of the foil strip. Tubes of that kind are referred to as longitudinal seam-welded tubes. Those tubes can be decorated at a comparatively low cost in terms of printing procedure, insofar as the foil strips can be printed upon while in a condition of lying flat, before being formed into a tube. They suffer from the disadvantages however that longitudinal seam-welded tubes naturally cannot entirely attain the quality feature of "handling neutrality", and the welded seam as such remains an area which suffers certain reservations from the point of view of the engineer dealing with the plastic materials and the man skilled in the art of plastic welding, depending on the nature of the respective plastic materials used. Those reservations arise out of possible variations in the material of the seam in comparison with that of the rest of the wall of the tube, a tendency on the part of the material which is to be welded to being squeezed out during the welding operation, that is to say, a tendency to suffer from so-called flake-like extrusion phenomena which contaminate the packaged material, a freedom from cracks, flaws or tears between the seam and the adjoining wall of the tube body, an unequal diffusion barrier effect on the part of the seam and the rest of the material of the wall of the tube, and also a shrinkage characteristic on the part of the seam, which is difficult to determine and which is generally governed by the rate of manufacture, after fusing, pressing and cooling of the plastic material at the edge portions of the foil, such operations being effected to produce the seam. Those reservations are empirically ascertained in regard to individual plastic materials as such and in terms of their individual effects, but generally not in regard to their combinational effects, that is to say if two or more of the above-mentioned technical limitations occur at the same time, which has the result that the average man skilled in the art who is concerned with the development and production of longitudinal seam-welded plastic tubes does not undertake replacing or exchanging a tried-and-tested plastic material by a new plastic material which is unknown in terms of its behaviour, without overcoming major technical prejudices, and that is the case all the more insofar as the effects of the reservations in part occur only after a time delay and sometimes only after the tube has been filled with packaging material.

Taking transparent packaging containers, produced in particular from PET, by deep-drawing and stretching, as the basic starting point, the invention aims to provide for the production of an identical packaging container, namely a packaging tube, by means of longitudinal seam welding, and determining a plastic material which can be used therefor, that is to say the invention sets forth the problem which is solved by means of the features of claim 1.

European patent specification No 0 496 704 discloses a longitudinal seam-welded packaging tube, the tube body of which is formed from three-layer plastic laminate. The laminate includes a central layer of PET lined on both sides with a layer of a polyethylene, wherein the central layer of PET performs the function of a barrier layer and the polyethylene layers form the welded seam as polyethylene has significantly better weldability than PET. EP 496 704 teaches the man skilled in the art of plastic tube production that PET can be used as a component of a multi-layer laminate, but identifies this teaching in comparison with other plastic materials with weldability which cannot be readily accomplished, so that to solve the problem of the present invention, having regard to the reservations which are crucial to him, the man skilled in the art does not readily turn to use of the claimed tube material.

SUMMARY OF THE INVENTION

The use of the material according to the invention for the production of packaging tubes by means of longitudinal seam welding makes it possible to produce tubes of the same transparency as blow-moulded bottles, which in terms of colour can be decorated and also embossed at comparably low expenditure in terms of printing procedure (printing a flat article before it is formed into a tube). Handling neutrality is not entirely but approximately achieved insofar as the seam affords a surface structure which blurs for the user of the tube the feel impression of a technically governed surface impairment. Surprisingly the welding operation which in itself is technically demanding did not result in intolerable changes in material and squeezing-out phenomena, that is to say extrusion effects; in addition there were no problems in regard to freedom from cracks, flaws and tears and differences in diffusion barrier effects. Furthermore, contrary to expectation, post-shrinkage occurred to such a slight degree that distortion of the welded tube body to form a "banana-like" shape, as is frequently to be encountered when using plastic materials, is negligible. In addition, a higher output of tubes can be achieved with the welding operation, per unit of time, than when using deep-drawing and stretching.

BRIEF DESCRIPTION OF THE DRAWINGS

Further advantages, features and details of the invention are apparent from the following description of a preferred embodiment of a tube constructed in accordance with the invention, and the drawings in which.

DETAILED DESCRIPTION OF THE INVENTION

Figure 1:
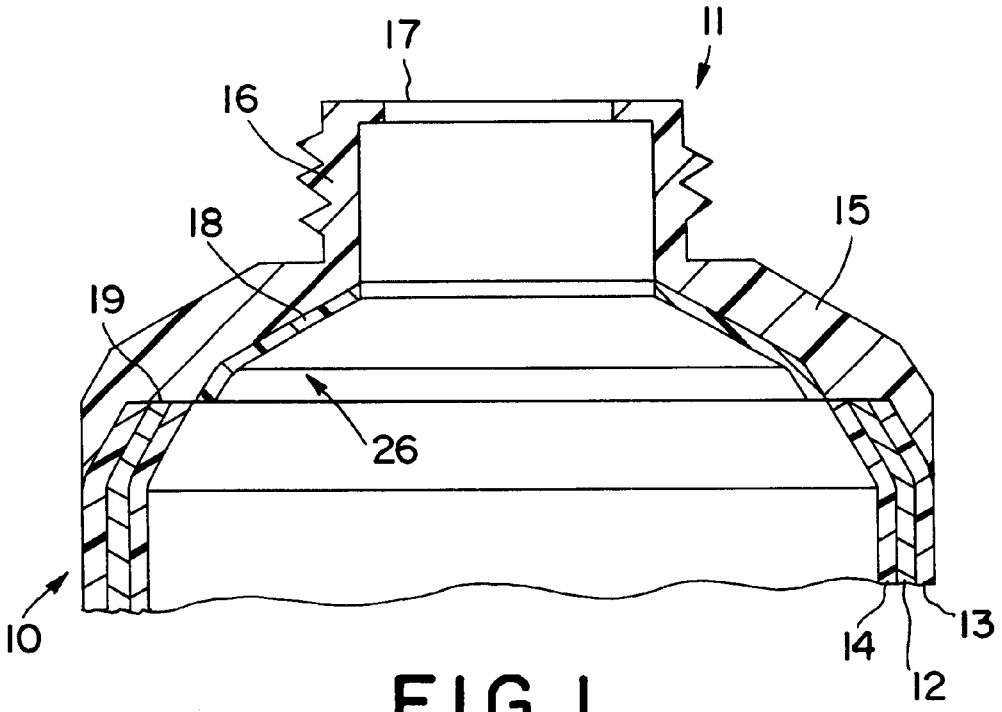
FIG. 1 is a view in axial section of a first embodiment of a tube end with a tube head and a tube body comprising a single plastic foil.
Figure 2:
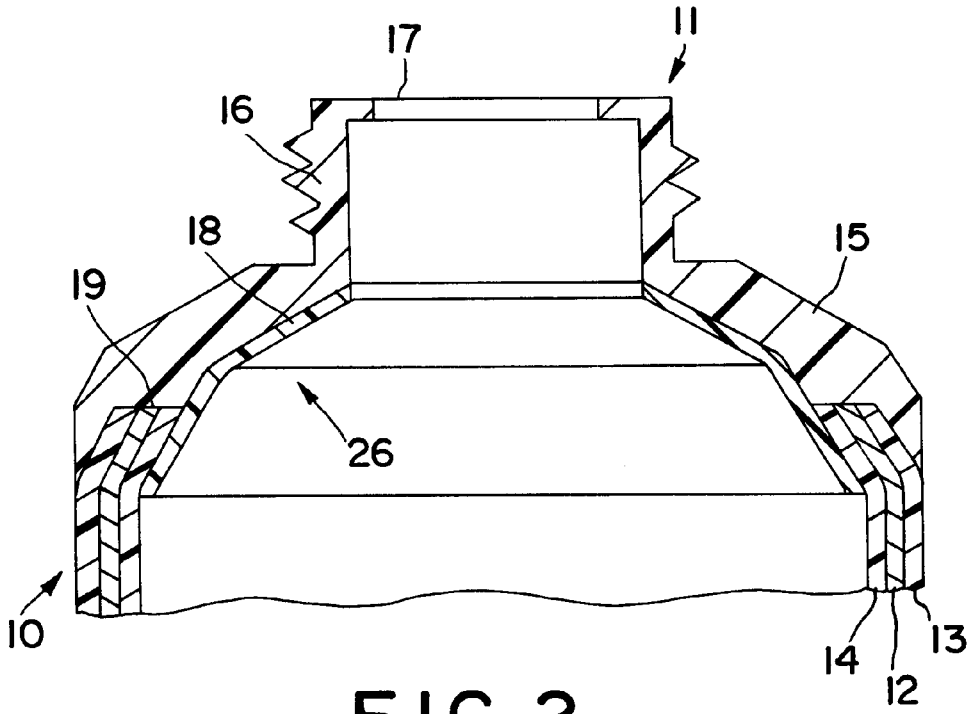
FIG. 2 shows a second embodiment as illustrated in FIG. 1 with a tube body comprising a plastic laminate.

In FIGS. 1 and 2 (the same parts are denoted by the same references in FIGS. 1 and 2), reference numeral 10 denotes tube bodies which are illustrated only in their end region towards the head and which, together with the heads identified by reference numeral 11, each form part of a respective packaging tube. The head 11, also referred to as the head portion, is formed from a shoulder portion 15 and a discharge portion 16 with discharge opening 17, wherein on its outward surface the discharge portion 16 has engagement means for a tube closure, for example it carries a screw thread. When using the same material as for the tube 10 (for example PET-G) the head 11 is formed by pressing a plasticised blank, by pressing shaping. The step of connecting the tube body 10 and the step of forming the head 11 are preferably effected in one working step insofar as in the pressing shaping operation, tube bodies 10 are introduced at one end into pressing moulds, fused by radiant heat, contact heat or outside heating, and joined in that condition to the heads which are formed in the pressing mould.

If the tube body 10 and the head 11 should have markedly different permeability values in respect of flavouring substances and scents, oxygen and carbon dioxide, in which respect the head 11 is assumed to have higher values than the tube 10, then the head 11, as shown in FIGS. 1 and 2, can be provided with diffusion-barrier means 26 in the form of plate-shaped discs 18. They bear against the side of the shoulder portion 15, which is towards the interior of the tube 11, and, in the case of the embodiment shown in FIG. 1, they extend at one end from the tube body end 19 to the entry opening of the discharge portion 16. In the embodiment shown in FIG. 2 the plate-shaped disc 18 engages over the tube body end 19 which is introduced into the shoulder portion 15, thereby achieving enhanced sealing integrity in respect of the head 22.

As shown in FIG. 1 the tube body 10 comprises a foil strip which is formed using PET and which was bent around a bar or mandrel to form a tube body portion and the longitudinal edges of which are connected, by virtue of heating, pressing and subsequent cooling, when forming a longitudinal weld seam. Preferably a foil strip comprising PET-G (polyethylene terephthalate of type designation G) is used for the tube body 10; out of all PETs PET-G can be best welded for the specified purpose and in moulds can be pressed to form the head 11 with simultaneous connection to the tube body. Good tubes which are glass-clear transparent, with adequate barrier effects, were produced using the materials according to the invention, insofar as the foil thickness was between 150 $\mu$m and 400 $\mu$m. Welded seams which were least striking from the visual point of view and in terms of feel were afforded if the overlap of the longitudinally extending foil edges was between 0.5 and 1.0 mm, the welding temperature was between 180° C. and 250° and the pressing pressure at that temperature was so set that the material of the fused foil edges flowed visibly into each other in the overlap region.

For substances to be packaged, which have volatile components and a certain degree of sensitivity to external influences such as the access of oxygen etc. but normally a short shelf life (a short storage and presentation period before sale to final consumers), the material used in accordance with the invention affords a sufficiently diffusion-inhibiting effect. For materials to be packaged, which involve a longer shelf life by virtue of their composition and thus their price, it may be appropriate to reinforce the diffusion barrier effect of the foil according to the invention. Examples of a tube body comprising a foil with a reinforced diffusion barrier effect are shown in FIG. 2. The foil of the tube body 10, to perform the desired purpose, is in the form of a three-layer plastic laminate comprising a layer 14, an intermediate layer 12 and a layer 13. After being shaped into a tube and welding, the layer 14 consisting of PET-G forms the inner surface of the tube body 10 while the layer 13 of PET-G forms the outer layer of the tube body 10. In accordance with the invention the same materials for the layers 13, 14 are preferred for good weldability of the edge portions of the foil. Disposed between the layers 13 and 14 is an intermediate layer 12, the function of which is further to reduce or entirely suppress the diffusion capability of the layers 13 and 14. As a further development of the invention along those lines, so-called A-PET (amorphous (A) polyethylene terephthalate) has been found to be highly advantageous as the material for the intermediate layer 12. Instead of an intermediate layer of A-PET, it is also possible to use a layer of glass ceramic (SIOX) as the intermediate layer 12 with a very good barrier action, in which respect the glass ceramic layer is preferably of a thickness of from 800 Angström to 1000 Angström. Those intermediate layers 12 do not adversely affect the "glass-clear transparent" manifestation of the tube body designed in accordance with the invention, while optimising the barrier action of the tube body.

What is claimed is:

1. A transparent packaging container comprising a plastic tube having a welded longitudinal seam, wherein said plastic consists of a multi-layer plastic laminate of polyethylene terephthalate (PET) wherein said multi-layered laminate material comprises a three-layer laminate comprising two layers of PET-G with an intermediate layer of A-PET.

* * * * *